US009301561B2

(12) United States Patent
Hanlon

(10) Patent No.: US 9,301,561 B2
(45) **Date of Patent: *Apr. 5, 2016**

(54) GEL CUSHION

(71) Applicant: Pull'r Holding Company, LLC, Schaumburg, IL (US)

(72) Inventor: Jared Hanlon, Santa Clarita, CA (US)

(73) Assignee: PULL'R HOLDING COMPANY, LLC, Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/459,521

(22) Filed: Aug. 14, 2014

(65) Prior Publication Data

US 2015/0033434 A1 Feb. 5, 2015

Related U.S. Application Data

(63) Continuation of application No. 12/589,689, filed on Oct. 26, 2009, now Pat. No. 8,815,372, which is a continuation of application No. 12/387,763, filed on May 6, 2009, now abandoned.

(60) Provisional application No. 61/050,975, filed on May 6, 2008.

(51) Int. Cl.

| | |
|---|---|
| ***B32B 3/00*** | (2006.01) |
| ***B32B 1/00*** | (2006.01) |
| ***B32B 3/12*** | (2006.01) |
| ***A41D 13/06*** | (2006.01) |
| ***A41D 31/00*** | (2006.01) |
| ***A41D 13/015*** | (2006.01) |

(52) U.S. Cl.

CPC ..... *A41D 13/065* (2013.01); *A41D 13/015* (2013.01); *A41D 31/0044* (2013.01); *Y10T 428/24612* (2015.01); *Y10T 428/24661* (2015.01)

(58) Field of Classification Search

CPC ..... A41D 13/015; A41D 13/065; A41D 31/0044; Y10T 428/24612; Y10T 428/24661; B32B 3/00; B32B 1/00; B32B 3/30

USPC ..... 428/72, 172, 174, 178, 179, 180; 5/653, 5/654, 655.5, 909; 248/118.1; 2/24, 413; 297/452.41

See application file for complete search history.

(56) References Cited

U.S. PATENT DOCUMENTS 8,815,372 B2 * 8/2014 Hanlon ..... 428/172

* cited by examiner

*Primary Examiner* — Catherine A Simone

(74) *Attorney, Agent, or Firm* — Cherskov Flaynik & Gurda, LLC

(57) ABSTRACT

A gel cushion, such as may be incorporated in a knee pad or other body-worn pad, that avoids undue accumulation of heat within the cushion, and that provides a stable and comfortable resting surface for at least a portion of a user's body. The cushion may further provide decreasing incremental compression in response to incrementally increasing loads, whereby users of different weights may be comfortably supported thereon.

12 Claims, 2 Drawing Sheets

GEL CUSHION

CROSS REFERENCE TO RELATED APPLICATIONS

This application claims priority benefit as a continuation of U.S. Utility application Ser. No. 12/589,689 filed on Oct. 26, 2009 currently pending which in turn claims the benefit of U.S. Utility application Ser. No. 12/387,763 filed on May 6, 2009 currently abandoned the contents of which is hereby incorporated by reference, which in turn claimed priority to U.S. Provisional Application Ser. No. 61/050,975 filed on May 6, 2008, the contents of which is hereby incorporated by reference.

TECHNICAL FIELD

The present disclosure relates generally to force absorbing devices, and, more particularly, to a gel cushion having a plurality of convex projections.

BACKGROUND OF THE INVENTION

Various activities, such as many occupational activities, recreational activities, or the like, involve repetitive forces. For example, activities that require kneeling for some duration of time impart forces to an individual's knees. As is well known, prolonged periods of exposure to such forces and/or exposure to repetitive forces can cause or contribute to the development or onset of tissue and/or bone damage or injury. For example, bruising, tendon strain, cartilage damage, bursitis, and even osteoarthritis can result or be exacerbated by such exposure to forces. Accordingly, pads and cushions, such as knee pads, have been developed and implemented in attempts to reduce the damage and discomfort associated with such activities. For example, fabric knee pads have been designed to wrap around a user's knee. Additionally, cupped knee pads have been used in an effort to provide better support for the user's knee.

Unfortunately, however, such pads suffer from a number of disadvantageous performance characteristics. Particularly, the pads include simple cushion material, such as foam or fabric batting. Such material exhibits varying levels of cushion for different users, particularly based on the user's weight. Since the pads are all made with substantially the same amount of padding material, most users find that the cushioning provided is either too great, wherein the pad is not stable, or wherein the cushioning provided is too little, wherein the user experiences discomfort due to complete compression or deformation of the padding material. Additionally, and especially where a conforming cup is provided, the padding functions as a thermal insulator, whereby the user's skin may become hot, sweaty, and uncomfortable, and whereby the pad may experience premature wear and/or may become excessively soiled. Furthermore, conventional cushion materials are directionally unbiased, whereby in addition to compressing in a desired direction, the cushion may also shear or deform in directions other than the desired direction. Such off-axis compression or deformation causes unsteadiness, which can sap a wearer's energy due to the constant need to shift position or weight to maintain or regain balance.

Thus, it is clear that there is an unmet need for a cushion that provides beneficial cushioning levels to facilitate user comfort, that prevents undue heat accumulation or retention, and that provides stability.

BRIEF SUMMARY OF THE INVENTION

Briefly described, in an exemplary embodiment, the cushion of the present disclosure overcomes the above-mentioned disadvantages and meets the recognized need for such a device by providing a gel cushion having a plurality of resilient mounds dispersed about an exterior surface thereof.

More specifically, the gel cushion, such as may be incorporated into a knee pad or other body-worn pad, preferably includes a substantially thin planar member having two generally opposing major surfaces and a plurality of mounds formed on a first of the major surfaces. The mounds are preferably formed having a substantially hemispherical or ellipsoidal surface intersecting the first surface proximate an equator of the hemispherical or ellipsoidal surface. The mounds are further preferably arranged in an array having at least two columns and at least two rows, wherein the planar member includes a space between adjacent mounds.

The resilient material is preferably formed of a polymer gel, or other suitable material, whereby the mounds may preferably deform, at least partially, in a compression direction, i.e. in a direction perpendicular to the generally planar surface, in response to a force applied thereto while resisting such a force, such as a force imparted to the mounds when a user rests thereon. Thus, the resilient mounds preferably cushion a portion of a user's body disposed thereagainst, especially when bearing the user's weight. The resilient material and/or the substantially hemispherical or ellipsoidal shape of the mounds preferably provide(s) an increasing resistance force and preferably deform to a greater extent in response to an increasing load applied thereto. Accordingly, the mounds preferably accommodate users of different weight, and provide sufficient cushioning to comfort a user resting thereon.

Additionally, the selective arrangement of the rows of mounds preferably provides stability to a user resting thereon. For example, two rows may be arranged generally proximate and on opposite sides of a longitudinal axis of the cushion. Thus, when a user places a portion of their body generally centrally on the cushion, the rows preferably straddle the portion of the user's body and resist lateral movement of the user's body relative to the cushion. Such resistance of lateral movement is preferably provided by mounds of each row generally retaining the user's body, or at least the portion thereof, partially between adjacent mounds of each row. Furthermore, the resilient material and/or the substantially hemispherical or ellipsoidal shape of the mounds preferably provide(s) a resistance force to oppose lateral or shear forces. Such lateral or shear resistance force may preferably result in less lateral deformation than a compression deformation exhibited in response to an equal force in the compression direction.

Such arrangement of two rows or mounds preferably further provides a plurality of fluid channels formed between the mounds. That is to say, a fluid channel is preferably formed generally along the longitudinal axis between the rows, and a plurality of transverse fluid channels are preferably formed generally between adjacent ones of the mounds within each row. Thus, fluid, such as air, may circulate through the cushion between the generally planar member and the portion of the user's body disposed against one or more mound(s).

Accordingly, one feature and advantage of the cushion of the present disclosure is its ability to provide cushioning substantially proportionate to a force applied thereto, whereby relatively smaller forces are cushioned by partial deformation of a resilient material, and whereby incremental increases in a force applied to the resilient material result in sequentially smaller amounts of additional deformation.

Another feature and advantage of the cushion of the present disclosure is its ability to securely cushion a portion of a user's body by resistance of lateral forces and/or via at least partially cupping the portion of the user's body.

Yet another feature and advantage of the cushion of the present disclosure is its ability to resist or prevent accumulation of excess thermal energy, whereby discomfort associated with heat and/or sweating may be avoided.

These and other features and advantages of the cushion of the present disclosure will become more apparent to those ordinarily skilled in the art after reading the following Detailed Description of the Invention and Claims in light of the accompanying drawing Figure.

BRIEF DESCRIPTION OF THE DRAWINGS

Accordingly, the present disclosure will be understood best through consideration of, and with reference to, the following drawing, viewed in conjunction with the Detailed Description of the Invention referring thereto, in which.

Figure 1:
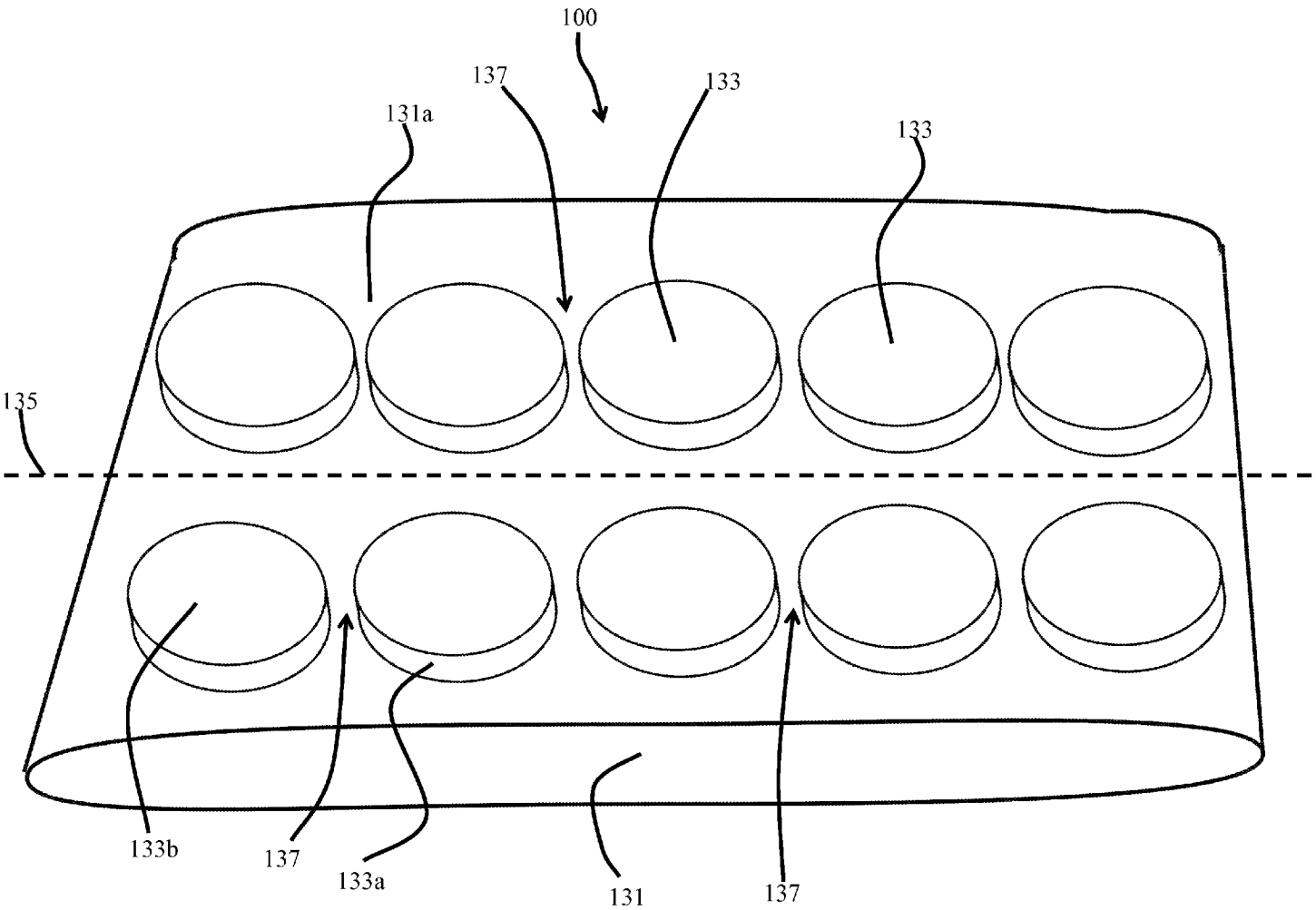
FIG. 1 is a front perspective view of a cushion.

It is to be noted that the drawing presented is intended solely for the purpose of illustration and that it is, therefore, neither desired nor intended to limit the scope of the disclosure to any or all of the exact details of construction shown, except insofar as they may be deemed essential to the claimed invention.

DETAILED DESCRIPTION OF THE INVENTION

In describing the cushion of the present disclosure illustrated in the drawing, specific terminology is employed for the sake of clarity. The claimed invention, however, is not intended to be limited to the specific terminology so selected, and it is to be understood that each specific element includes all technical equivalents that operate in a similar manner to accomplish a similar purpose.

In that form of the cushion of the present disclosure chosen for purposes of illustration, FIG. 1 shows cushion 100 including two or more mounds 133 formed over face 131*a* of generally thin planar member 131. Mounds 133 disposed over face 131*a* of planar member 131 are preferably arranged in an array, including two rows of two or more mounds 133. As illustrated, planar member 131 includes 10 mounds 133 arranged in two parallel rows disposed on opposite sides of central longitudinal axis 135. As will be understood by those ordinarily skilled in the art, other numbers of mounds 133 and/or alternative configurations of mounds 133 may be included as desired to accomplish the functions described herein. Thus, mounds 133 preferably define a plurality of channels 137 therebetween, including a central channel extending generally along central axis 135. Each mound 133 preferably includes a generally cylindrical base portion 133*a* and generally convex upper portion 133*b*. Preferably, convex upper portion 133*b* is formed as a portion of a sphere or a portion of an ellipsoid, although any suitable generally convex surface may be employed. Generally cylindrical base portion 133*a* preferably resists lateral forces, i.e. forces applied parallel to the plane of member 131, while the gel material of each mound 133 may compress in a direction generally perpendicular to the plane of member 131 in response to a force applied to the mound 133. Additionally, or alternatively, such resistance of lateral forces may be accomplished and/or enhanced by inclusion of fibers within planar member 131, or the like, whereby resilience in lateral directions may be increased compared to the resilience in the compression direction (perpendicular to the plane of member 131). The cushion 100 is preferably formed via a molding process whereby planar member 131 and mounds 133 may be integrally formed as a monolithic body.

Figure 2:
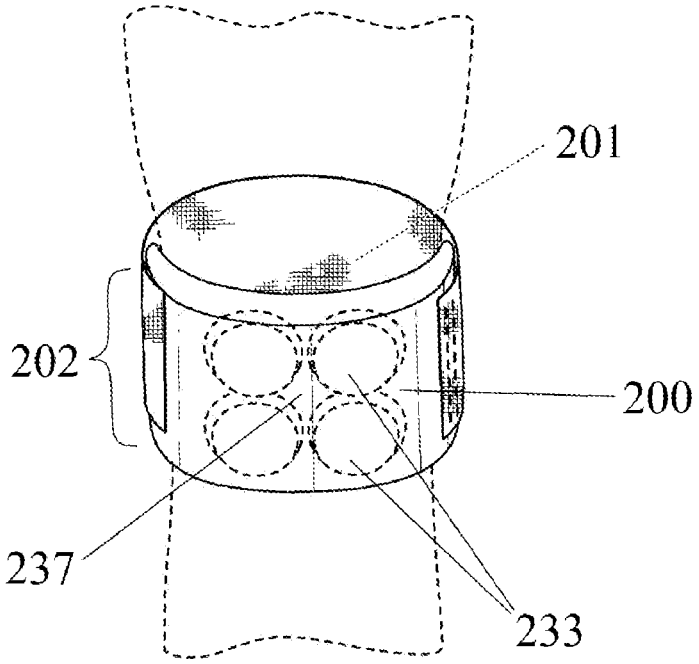
FIG. 2 is another front perspective view of a cushion

As shown in FIG. 2, in an exemplary method of use, cushion 200 may be engaged with a portion of a user's body, such as the user's knee 201, for use in protecting the user from injury or the like. Pad 200 may be engaged with the user's body via standing, kneeling, lying or otherwise resting thereon, or via wrapping one or more strap or the like around the user's body. Thus, at least a portion of a force from a user's body is transmitted to at least one, and preferably a plurality of mounds 233. For example, a user's knee may be centrally disposed between an array 202 of four mounds 233, and whereby the user's knee may be cushioned by each of the four mounds, and whereby the user's knee is disposed proximate a plurality of channels 237. Thus, the user's knee, or other body part, may be cooled via air or other fluid flow through the channel(s). Furthermore, when the user's knee or other body part is so disposed between a plurality of mounds, the mounds preferably securely retain the user's knee therebetween, even when lateral forces are applied, by resisting such lateral forces to substantially prevent relative lateral motion between cushion 100 and the user's knee 201 or other body part. Thus, the user's knee may be cradled within cushion 200 to provide a stable base for supporting the user without completely covering the user's skin.

Figure 3:
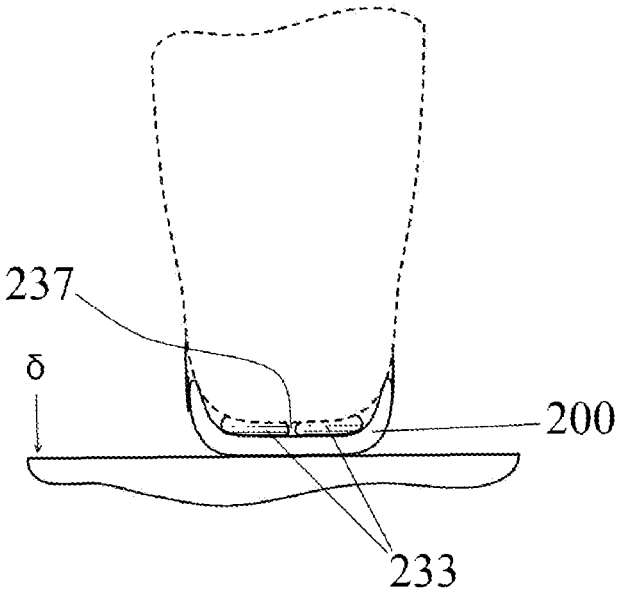
FIG. 3 is a side view of a cushion

Additionally, and as shown in FIG. 3, as the user applies a force 6, such as the user's weight, to the cushion 200, an amount of compression per unit of force preferably decreases with increasing total compression. That is to say, each of mounds 233 preferably compresses a relatively larger distance for a first incremental value of force applied, and preferably compresses a relatively smaller distance for additional incremental increase of the value of force applied. Preferably, cushion 200 is formed such that application of a force equal to a maximum load of cushion 200 does not result in complete compression of any of mounds 233, whereby channels 237 defined between mounds 237 are not eliminated. Thus, users of different weights may preferably comfortably use cushion 200 having mounds 233, due to the ability of the pad to adequately cushion both relatively large and relatively small forces without exhibiting relatively little compression for smaller forces and without exhibiting relatively great compression for larger forces.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

The embodiment of the invention in which an exclusive property or privilege is claimed is defined as follows:

1. A method of cushioning comprising:

providing a planar member having an integrally molded first surface and a second surface;

engaging the user with the first surface of the planar member wherein said first surface comprises an array of resilient mounds wherein each mound of said array contains a resilient gel material; and cushioning a force applied to the planar member wherein the array of resilient mounds is adapted to partially deform in response to the force applied thereto wherein each mound compresses a relatively larger distance for a first incremental value of force applied, and thereafter compresses a relatively smaller distance for additional incremental increase of the value of force applied and wherein the mounds of the array of resilient mounds define at least one channel between said mounds and wherein said at least one channel remains open during maximum compression of said mounds.

2. The method of claim 1 wherein the planar member further comprises a longitudinal axis running through a mid-section of the planar member.

3. The method of claim 2 wherein the force cushioned is perpendicular to the longitudinal axis of the planar member.

4. The method of claim 2 wherein the force cushioned is parallel to the longitudinal axis of the planar member.

5. The method of claim 2 wherein the mounds of the mound array reversibly deform in response to a compression force applied perpendicular to the longitudinal axis of the planar member.

6. The method of claim 1 wherein at least one mound of the first surface mound array includes a cylindrical base portion and a convex upper portion.

7. The method of claim 1 wherein the mound array comprises at least two columns and at least two rows of resilient mounds.

8. The method of claim 1 wherein the mound array comprises a series of rows and wherein said rows straddle a longitudinal axis of the planar member forming at least one channel.

9. The method of claim 1 wherein the mounds comprise an upper portion wherein said upper portion is convex in relation to the planar member.

10. The method of claim 1 wherein the planar member further comprises fibers.

11. The method of claim 1 wherein each mound of the first surface mound array is hemispherical or ellipsoidal.

12. The method of claim 1 wherein the mound array comprises at least two columns and at least two rows.

* * * * *